US006358219B1

(12) United States Patent
Arkans

(10) Patent No.: US 6,358,219 B1
(45) Date of Patent: Mar. 19, 2002

(54) SYSTEM AND METHOD OF IMPROVING VASCULAR BLOOD FLOW

(75) Inventor: Ed Arkans, Carlsbad, CA (US)

(73) Assignee: ACI Medical, San Marcos, CA (US)

( * ) Notice: Subject to any disclaimer, the term of this patent is extended or adjusted under 35 U.S.C. 154(b) by 0 days.

(21) Appl. No.: 09/604,624

(22) Filed: Jun. 27, 2000

Related U.S. Application Data

(63) Continuation-in-part of application No. 08/706,720, filed on Sep. 6, 1996, now Pat. No. 6,129,688.

(51) Int. Cl.[7] ..... A61H 9/00
(52) U.S. Cl. ..... 601/152; 601/151
(58) Field of Search ..... 601/148, 149, 601/150, 151, 152

(56) References Cited

U.S. PATENT DOCUMENTS 1,492,514 A 4/1924 Jensen
1,608,239 A 11/1926 Rosett (List continued on next page.)

FOREIGN PATENT DOCUMENTS

DE 2433794 1/1976
DE 2716137 7/1978

(List continued on next page.)

OTHER PUBLICATIONS

Rastgeldi, "Pressure Treatment of Peripheral Vascular Diseases, A Short Historical Review" and "Intermitten Pressure Treatment of Peripheral Vascular Diseases, A Survey of Sixteen Years Personal Experience" published in *Opuscula Medica*, Supplementum XXVII 1972, Grundad av Sixten Kallner 1956.

Gardner et al, "The Venous Pump of the Foot–Preliminary Report," published in the Jul. 1983 issue of the *Bristol Medico–Chirurgical Journal* at pp. 109–112.

"Design Fault," published in *Legal Business Magazine*, Oct. 1993, at pp. 44–48.

James P. Henry and Travis Winsor, "Compensation of Arterial Insufficiency by Augmenting the Circulation with Intermittent Compression of the Limbs," *American Heart Journal*, Jul. 1965.

Steinberg, "Cardiosynchronous Limb Compression: Effects on Noninvasive Vascular Test and Clinical Course of the Ischemic Limb," *The Journal of Vascular Disease*, vol. 43, No. 6, Jun. 1992.

Gaskell and Parrott, "The Effect of a Mechanical Venous Pump on the Circulation of the Feet in the Presence of Arterial Obstruction," *Surgery, Gynecology & Obstetrics*, Apr. 1978.

*Primary Examiner*—Jeanette Chapman
*Assistant Examiner*—Benjamin K. Koo
(74) *Attorney, Agent, or Firm*—Workman, Nydegger & Seeley

(57) ABSTRACT

A medical apparatus to increase vascular blood flow in the lower extremities of the patient is presented. The medical apparatus is designed to increase vascular blood flow by applying a compressive force to specific regions of the foot, ankle, and/or calf. To achieve this end, the present invention has a foot compression portion and a calf compression portion. The two portions are connected by a severable connection. The severable connection allows the foot portion and calf portion to be used together, or allows the calf portion to be used alone. The foot compression portion is adapted to exert an upward compressive force to the sole of the foot from in front of the heel and extending past the ball of the foot under the phalanges, a downward compressive force in front of the tarsal region of the foot, a downward compressive force in the upper tarsal region of the foot, and a compressive force around the Achilles tendon. The foot compression portion is also adapted to be incapable of applying a downward compressive force in the midtarsal region of the foot. The calf compression portion is designed to apply a compressive force to the dorsal region of the calf.

27 Claims, 7 Drawing Sheets

U.S. PATENT DOCUMENTS

| | | | | |
|---|---|---|---|---|
| 2,531,074 | A | | 11/1950 | Miller |
| 2,694,395 | A | | 11/1954 | Brown |
| 2,781,041 | A | | 2/1957 | Weinberg |
| 2,842,655 | A | | 7/1958 | Schwebel |
| 2,880,721 | A | | 4/1959 | Corcoran |
| 2,884,646 | A | | 5/1959 | Alber |
| 3,153,413 | A | | 10/1964 | Gottfried |
| 3,171,410 | A | | 3/1965 | Towle et al. |
| 3,179,106 | A | | 4/1965 | Meredith |
| 3,186,404 | A | | 6/1965 | Gardner |
| RE26,046 | E | | 6/1966 | Gottfried |
| 3,286,711 | A | | 11/1966 | MacLeod |
| 3,338,237 | A | | 8/1967 | Sconce |
| 3,403,673 | A | | 10/1968 | MacLeod |
| 3,450,450 | A | | 6/1969 | Hopkins et al. |
| 3,454,010 | A | | 7/1969 | Lilligren et al. |
| 3,525,333 | A | | 8/1970 | Mencacci |
| 3,811,431 | A | | 5/1974 | Apstein |
| 3,824,992 | A | | 7/1974 | Nicholson et al. |
| 3,826,249 | A | | 7/1974 | Lee et al. |
| 3,859,989 | A | | 1/1975 | Spielberg |
| 3,865,102 | A | | 2/1975 | Birtwell et al. |
| 3,865,103 | A | | 2/1975 | Folman |
| 3,888,242 | A | | 6/1975 | Harris et al. |
| 3,892,229 | A | | 7/1975 | Taylor et al. |
| 3,901,221 | A | | 8/1975 | Nicholson et al. |
| 3,908,642 | A | | 9/1975 | Vinmont |
| 3,920,006 | A | | 11/1975 | Lapidus |
| 3,942,518 | A | | 3/1976 | Tenteris et al. |
| 3,976,056 | A | | 8/1976 | Brawn |
| 3,982,531 | A | | 9/1976 | Shaffer |
| 3,993,053 | A | | 11/1976 | Grossan |
| 4,013,069 | A | | 3/1977 | Hasty |
| 4,044,759 | A | | 8/1977 | Ghayouran |
| 4,054,129 | A | | 10/1977 | Byars et al. |
| 4,066,084 | A | | 1/1978 | Tillander |
| 4,077,402 | A | | 3/1978 | Benjamin, Jr. et al. |
| 4,091,804 | A | | 5/1978 | Hasty |
| 4,153,050 | A | | 5/1979 | Bishop et al. |
| 4,186,732 | A | | 2/1980 | Chrisoffel |
| 4,198,961 | A | | 4/1980 | Arkans |
| 4,202,325 | A | | 5/1980 | Vallari et al. |
| 4,206,751 | A | | 6/1980 | Schneider |
| 4,207,876 | A | | 6/1980 | Annis |
| 4,231,355 | A | | 11/1980 | Hara |
| 4,269,175 | A | | 5/1981 | Dillon |
| 4,311,135 | A | | 1/1982 | Brueckner et al. |
| 4,370,975 | A | | 2/1983 | Wright |
| 4,372,297 | A | | 2/1983 | Perlin |
| 4,374,518 | A | | 2/1983 | Villanueva |
| 4,388,919 | A | | 6/1983 | Benjamin, Jr. et al. |
| 4,396,010 | A | | 8/1983 | Arkans |
| 4,402,312 | A | | 9/1983 | Villari et al. |
| 4,418,690 | A | | 12/1983 | Mummert |
| 4,453,538 | A | | 6/1984 | Whitney |
| 4,502,470 | A | | 3/1985 | Kiser et al. |
| 4,577,626 | A | | 3/1986 | Marukawa et al. |
| 4,614,179 | A | | 9/1986 | Gardner et al. |
| 4,614,180 | A | | 9/1986 | Gardner et al. |
| 4,624,244 | A | | 11/1986 | Taheri |
| 4,696,289 | A | | 9/1987 | Gardner et al. |
| 4,702,232 | A | | 10/1987 | Gardner et al. |
| 4,706,658 | A | | 11/1987 | Cronin |
| 4,709,694 | A | | 12/1987 | O'Connell |
| 4,721,101 | A | | 1/1988 | Gardner et al. |
| 4,805,601 | A | | 2/1989 | Eischen, Sr. |
| RE32,939 | E | | 6/1989 | Gardner et al. |
| RE32,940 | E | | 6/1989 | Gardner et al. |
| 4,841,956 | A | * | 6/1989 | Gardner et al. |
| 4,846,160 | A | * | 7/1989 | Gardner et al. |
| 4,858,596 | A | * | 8/1989 | Kolstedt et al. |
| 4,938,208 | A | * | 7/1990 | Dye |
| 4,941,458 | A | * | 7/1990 | Gardner et al. |
| 4,947,834 | A | * | 8/1990 | Kartheus et al. |
| 4,989,589 | A | * | 2/1991 | Pekanmäki et al. |
| 5,052,377 | A | * | 10/1991 | Frajdenrajch |
| 5,092,317 | A | * | 3/1992 | Zelikovski |
| 5,218,954 | A | * | 6/1993 | Van Bemmelen |
| 5,354,260 | A | * | 10/1994 | Cook |
| 5,443,440 | A | * | 8/1995 | Tumey et al. |
| 5,584,798 | A | * | 12/1996 | Fox |

FOREIGN PATENT DOCUMENTS

| | | | |
|---|---|---|---|
| EP | 0150553 | * | 8/1985 |
| EP | 0221636 | * | 5/1987 |
| FR | 2345992 | * | 10/1977 |
| FR | 2390156 | * | 12/1978 |
| FR | 2425239 | * | 12/1979 |
| GB | 233387 | | 5/1925 |
| GB | 473639 | | 10/1937 |
| GB | 479261 | | 2/1938 |
| GB | 490341 | | 8/1938 |
| GB | 754883 | | 8/1956 |
| GB | 813352 | | 5/1959 |
| GB | 817521 | | 7/1959 |
| GB | 1310492 | * | 3/1973 |
| GB | 2050174 | | 1/1981 |
| GB | 2055580 | | 3/1981 |
| GB | 2077108 | | 12/1981 |
| GB | 2103489 | | 2/1983 |
| GB | 2141938 | * | 1/1985 |
| SU | 197710 | * | 10/1967 |

* cited by examiner

SYSTEM AND METHOD OF IMPROVING VASCULAR BLOOD FLOW

RELATED APPLICATIONS

This application is a continuation-in-part of U.S. patent application Ser. No. 08/706,720, filed on Sep. 6, 1996, now U.S. Pat. No. 6,129,688.

FIELD OF THE INVENTION

The present invention relates to systems and methods for improving vascular blood flow, and more specifically (A) for improving arterial blood flow in the lower extremities by (a) increasing venous blood flow and (b) enhancing functionality of the vessels with high shear rates through compression of specific portions of the foot, ankle, and calf of a patient, and (B) for reducing the incidence of venous blood clot formation in the lower limbs by creating pulsatile venous flow and promoting venous emptying.

BACKGROUND

Improvement of arterial blood flow in patients with obstructions of the arteries to the leg is usually obtained by surgically bypassing the occluded arteries, or by removing obstructions with devices that are inserted into the blood vessel. In elderly patients who have undergone multiple vascular procedures, the deterioration of arterial blood flow can lead to severe pain (ischemic neuritis), tissue loss (arterial ulcers), or toe loss (gangrene). When the arteries cannot be repaired anymore, this situation may lead to leg amputation.

In order to increase vascular blood flow without surgery, devices are sometimes used which apply a compressive force to various designated areas of the foot or leg. This compressive force is designed to increase the amount of blood returning to the heart through the veins, thereby increasing the arterial blood flow to the extremity. These compressive forces are typically designed to mimic a walking action which helps to push blood through the veins to the heart.

In normal walking, the foot is intermittently weight bearing, a result of which is to flatten the plantar arch. This flattening motion causes a spreading force between the ball and heel of the foot and a squeezing of the sole of the foot. This action produces a foot-pump action that helps to increase the venous blood flow in the leg. Prior art devices have therefore focused on mimicking such a flattening of the plantar arch. This is usually performed by wrapping a bladder completely around the foot between the heel and the ball of the foot. A fluid is then injected into the bladder in order to create a compressive force both on the top and bottom of the foot. Such an approach, however, creates several problems.

Devices that compress the feet of certain sensitive patient groups, such as diabetics, may irritate the skin and ultimately lead to skin breakdown over the bony areas at the midtarsal region. The compression of this midtarsal region thus leads to a situation where compression therapy for a particular class of patients must be limited in duration in order to avoid such tissue breakdown. It would, therefore, be advantageous to allow compression therapy of this class of patients over a longer period of time without breakdown of the skin over the bony areas at the midtarsal region.

In addition to the breakdown of tissue over the midtarsal region for certain groups of patients, prior art devices also are not usable on that portion of the patient population which have abnormally shaped feet. For certain patients, a bladder which completely encircles the foot and extends in a region from about the heel to the ball of the foot will not fit. It would, therefore, be advantageous to allow compression therapy on a wide range of patients including those having abnormal foot shapes.

For certain patients who have extremely sensitive feet, the application of a compressive force on both the top and bottom of the foot can cause tremendous pain. Patients who have had reduced blood flow in the lower extremities for a long period of time are especially susceptible to pain when compression therapy of the foot is initiated. It would, therefore, be advantageous to allow for a treatment regime which gradually increases a patient's tolerance until compression therapy of the foot can be tolerated.

Finally, because the bladder completely encircles the foot, it can be difficult to assess the effectiveness of the treatment or to identify any developing problems. Since the bladder covers almost the entire foot, visual inspection can be difficult. Often to assess the effectiveness and identify developing problems, the treatment must be stopped and the device removed. It would, therefore, represent an advancement in the art to allow increased visual inspection during treatment with little or no impact on the effectiveness of the treatment.

Another problem suffered by patients is deep vein thrombosis. Deep vein thrombosis (DVT) is the formation of thrombus in the deep veins of the lower limb. DVT may follow trauma or surgery and is often associated with activated blood clotting factors and/or very slow blood flow called stasis. External pneumatic compression prevents stasis by two possible mechanism types: (1) a small volume of blood is accelerated to a relatively high velocity for a short period of time, and a large volume of blood is accelerated to a relatively low velocity for a longer period of time. Foot compression devices such as that described by Cook in U.S. Pat. No. 5,354,260 are examples of the first type in that the relatively small foot blood volume is accelerated rapidly to a high velocity. Calf and thigh compression devices such as that described by Hasty in U.S. Pat. No. 4,013,069 are examples of the second type in that a large blood volume in the calf and thigh are accelerated to relatively lower velocities for periods of time that typically exceed that of foot only compression types.

Since foot only compression does not significantly effect flow in some of the large veins in the calf (such as the so-called soleal sinuses where thrombi often originate), calf vein thrombi are still a large potential problem. Calf and thigh compression may move larger amounts of blood but stasis is better reduced with high blood velocities. It would, therefore, be desirable to be able to both create high blood velocities and move large blood volumes to provide patients with prophylaxis against deep vein thrombosis.

SUMMARY AND OBJECTS OF THE INVENTION

The foregoing problems in the prior state of the art have been successfully overcome by the present invention, which is directed to a system and method for increasing vascular blood flow in the lower extremities. Embodiments within the scope of the present invention may include a foot compression portion and a calf compression portion. The foot compression portion is designed to place compressive forces on particular locations of the foot and ankle. For example, embodiments may apply an upward compressive force to the sole of the foot from in front of the heel and extending past the ball of the foot to the phalanges. By extending the compressive force past the ball of the foot to the phalanges, the present invention more closely mimics the bend of the phalanges that occurs during waking.

Embodiments may also apply a downward compressive force in front of the tarsal region and a downward compressive force in the upper tarsal region. In these embodiments, the present invention leaves the midtarsal region open. This design carries several advantages over the prior art. For example, leaving the midtarsal region open allows visual inspection of the skin over the midtarsal region. This allows assessment of the health of the skin tissue by looking at the color and texture of the skin. Skin blood flow can also be assessed by applying sensors such as a laser Doppler flux probe or a photo plethysmographic probe. Finally, an underlying artery can be palpated for pulsatility by hand or by using an electric monitor incorporating a strain sensitive element or continuous wave ultrasonic Doppler probe that is placed on the skin over the artery.

Another advantage of leaving the midtarsal region open is that skin breakdown for sensitive patient groups, such as diabetics, is dramatically reduced thereby allowing for longer term application of compressive therapy. Finally, by placing straps to exert compressive forces only below the tarsal region and in the upper tarsal region, patients with a wide variety of foot shapes, including abnormal foot, shapes, can be more readily accommodated. Preferably, at least a portion of the dorsalis pedis artery in the region from where the deep plantar artery separates from the dorsalis pedis artery to where a portion of the dorsalis pedis artery descends between the proximal phalanges is open to allow visual and/or instrumental monitoring of blood flow.

Embodiments of the present invention may also apply a compressive force around the Achilles tendon anywhere in a region bounded essentially by the posterior portion of the calcaneus, the medial malleolus of the tibia, the Achilles tendon, and the posterior portion of the navicular. Applying compressive forces in this region actuates a pump that helps to push blood through the veins toward the heart.

The calf compression portion of the present invention is designed to apply a compressive force to the dorsal side of the calf. The compressive force is preferably a progressive force which starts toward the lower portion of the calf and progresses upward to the upper portion of the calf. The calf compression portion and the foot compression portion may be connected together to facilitate proper placement of the foot compression portion and calf compression portion.

The attachment between the foot compression portion and calf compression portion may also be severable in order to allow use of the calf compression portion apart from the foot compression portion. Such a feature allows a physician to apply calf compression therapy in order to increase the vascular blood flow. By applying calf compression therapy without foot compression therapy, blood flow can be increased in patient groups with extremely sensitive feet. After calf compression therapy has been applied, it may later be desirable to add foot compression therapy. This may be accomplished by simply placing the detached foot compression portion onto the patient for use in conjunction with the calf compression portion.

The compressive forces of both the foot compression portion and calf compression portion are preferably generated by an inflatable bladder enclosed within a retaining structure. The preferred retaining structure is pile material (such as that used by hook and pile fasteners) that encloses the inflatable bladders. Double-sided hook devices may then be used to retain straps at the locations which hold the bladder of the foot compression portion or the bladder of the calf compression portion in place.

The inflatable bladders of the foot compression portion and calf compression portion are preferably separate so that each can be inflated independently. The bladders are preferably filled by a large bore fitting adapter to carry fluid from a fluid source to the appropriate bladder.

The inflation, deflation, and delay rate as well as the pressure are adjustable over a wide range of parameters. Thus, when both the foot and calf inflation portions are used together, they may be inflated either simultaneously or progressively.

It is therefore a primary object of the present invention to provide for a medical device that increases vascular blood flow in the lower extremities that can be used with a wide range of patients, including those in sensitive patient classes.

Another object of the present invention is to provide for a medical device that improves vascular blood flow in the lower extremities and that allows visual inspection and monitoring of the midtarsal region of the foot.

Another object of the present invention is to provide for a medical device that improves vascular blood flow in the lower extremities and that allows visual and/or instrumental monitoring of blood flow in the midtarsal region of the foot.

Yet another object of the present invention is to provide for a medical device that improves vascular blood flow in the lower extremities that provides compression therapy to the foot and calf, or to the calf alone.

A still further object of the present invention is to provide a medical device that improves vascular blood flow in the lower extremities and that also reduces or eliminates tissue breakdown in the midtarsal region.

Another object of the present invention is to provide a medical device that can be used to treat deep vein thrombosis both by creating high blood velocities and by moving large blood volumes through rapid compression of areas of the foot, ankle, and calf.

Additional objects and advantages of the present invention will be set forth in the description which follows, and in part will be obvious from the description, or may be learned by practice of the invention. The objects and advantages of the present invention may be realized and obtained by means of the instruments and combinations particularly pointed out in the appended claims. These and other objects and features of the present invention will become more fully apparent from the following description and appended claims, or may be learned by practice of the invention as set forth hereinafter.

BRIEF DESCRIPTION OF THE DRAWINGS

In order to illustrate the manner in which the above-recited and other advantages and objects of the invention are obtained, a more particular description of the invention briefly described above will be rendered by reference to a specific embodiment thereof which is illustrated in the appended drawings. Understanding that these drawing depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 5A:
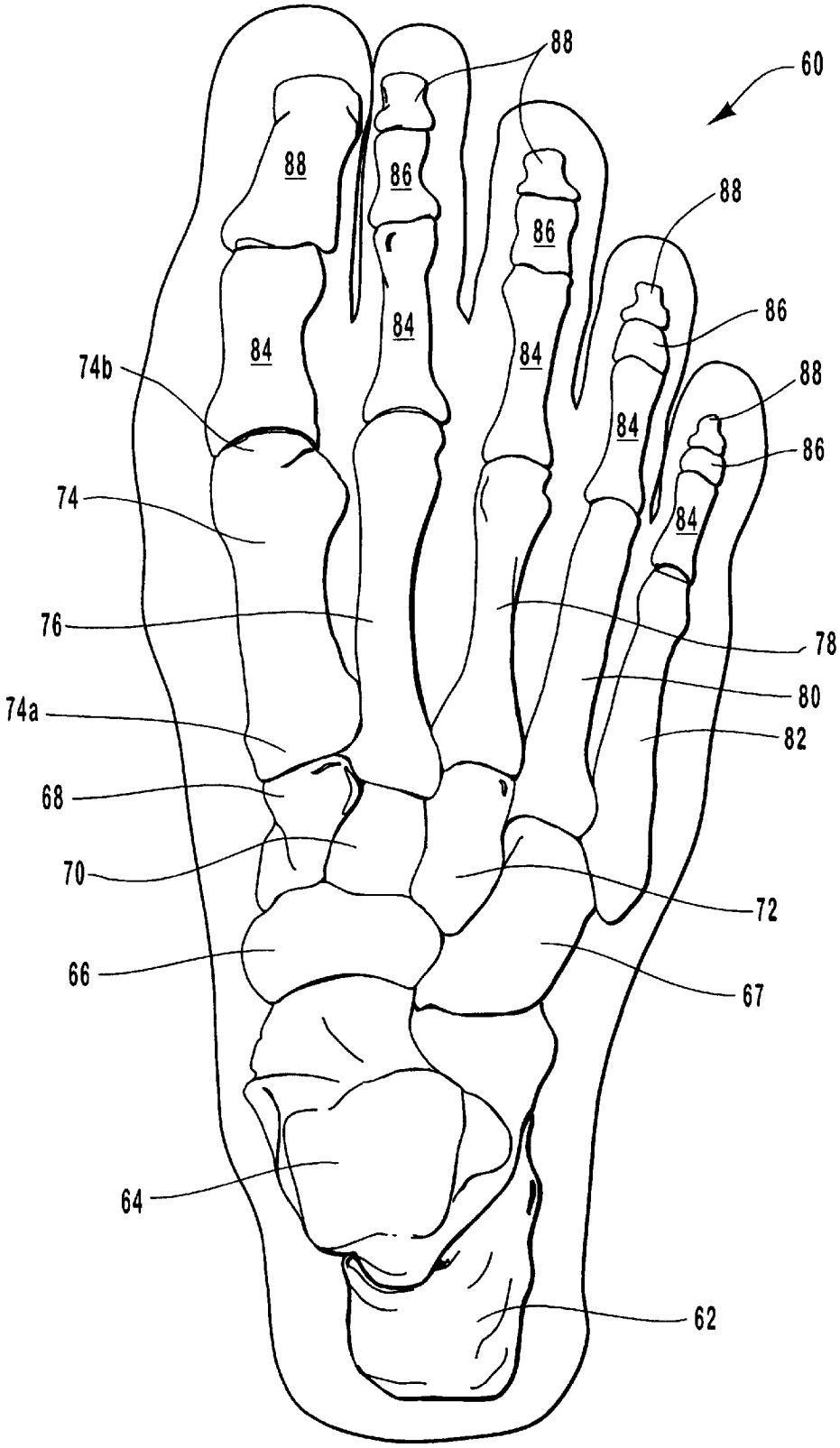
FIGS. 5A and 5B are top and side views of the foot, respectively, showing the various bones of the foot.
Figure 5B:
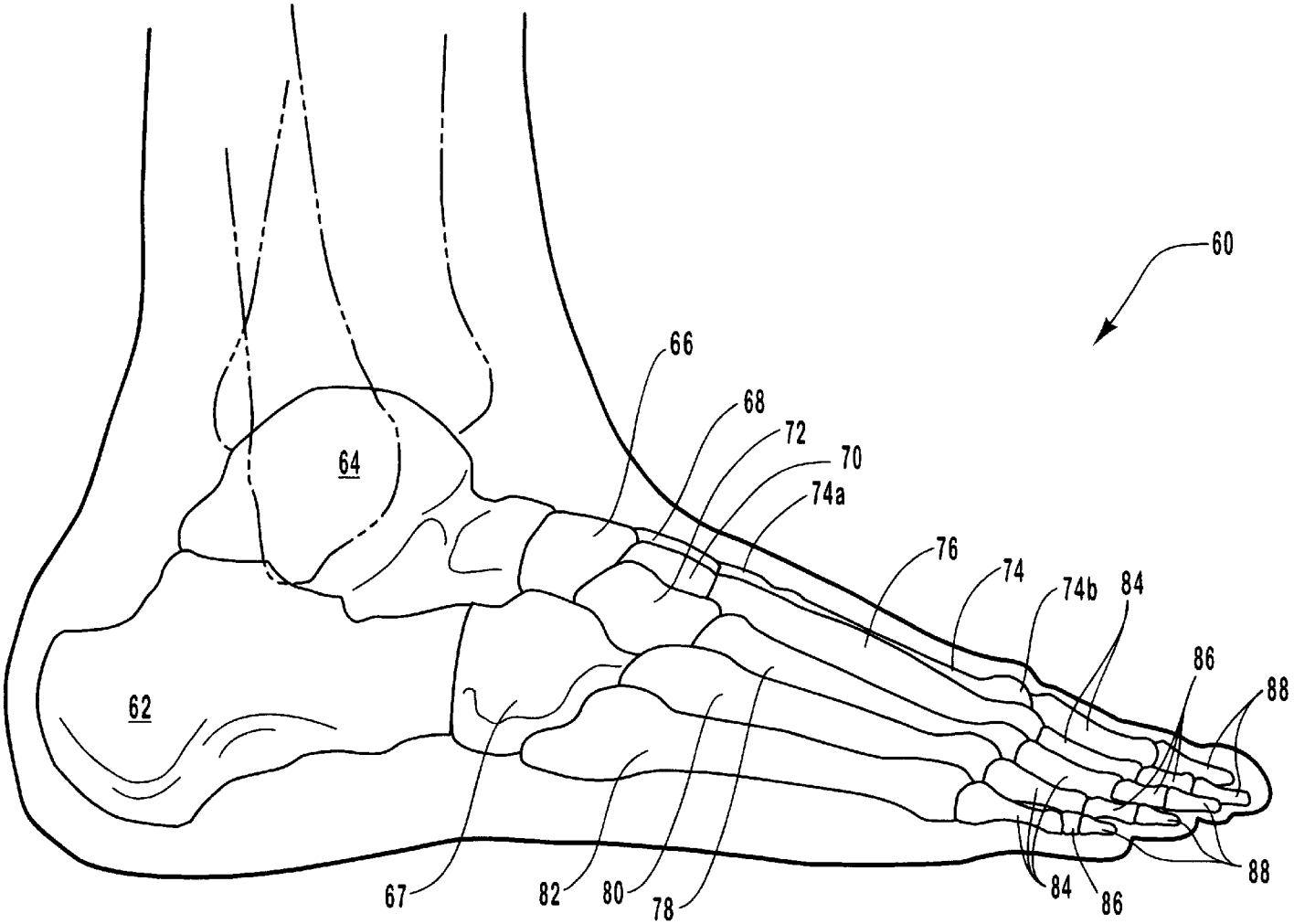
Figure 6:
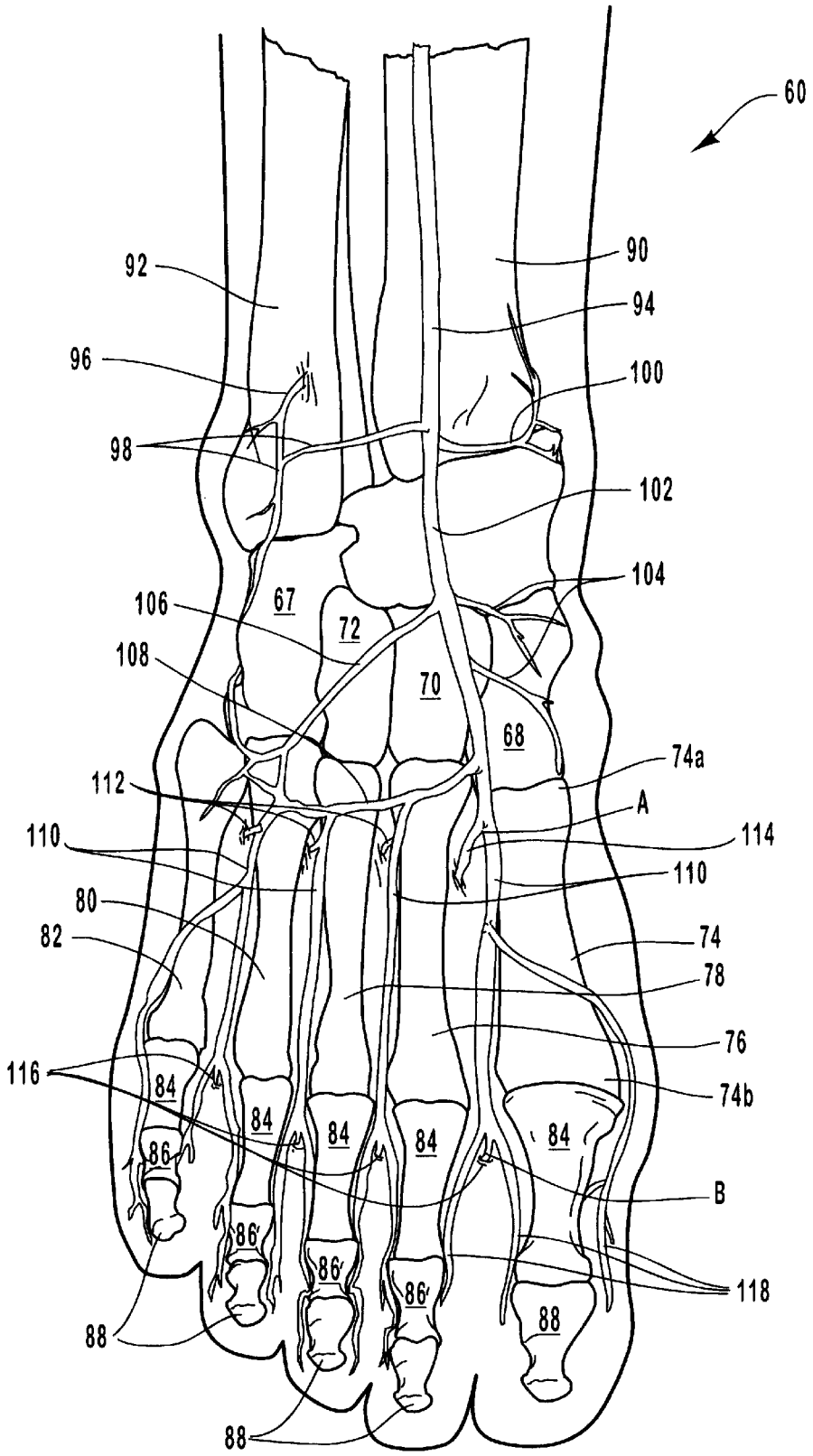
FIG. 6 is a view of the foot showing bones and arterial structure.

Throughout the following description, FIGS. 5A, 5B, and 6 will be referenced to help identify various bones or regions of the ankle and foot. FIGS. 5A and 5B show two views of the bone structure of a foot 60. In the following description, the term "proximal" is used to mean the direction toward the heel of the foot, and the term "distal" is used to mean the direction toward the toes of the foot. Foot 60 includes the calcaneus 62, the talus 64, the navicular 66, the cuboid 67, and the three cuneiforms: medial cuneiform 68, middle cuneiform 70, and lateral cuneiform 72. The "upper tarsal region" is generally the region proximal from the cuneiforms 68, 70 and 72, such as across the navicular 66 and the upper portion of the cuboid 67. The "Midtarsal region" is the region across the cuneiforms 68, 70 and 72. The phrase "in front of the tarsal region" will be used to generally refer to any region distal from the cuneiforms.

Distal from the cuneiforms are the five metatarsal bones: first metatarsal 74, second metatarsal 76, third metatarsal 78, fourth metatarsal 80 and fifth metatarsal 82. Each metatarsal has two ends, the proximal end being termed the "base" and the distal end being termed the "head." Thus, first metatarsal 74 includes the base 74*a* and the head 74*b*. The corresponding regions of the remaining metatarsal bones are not labeled. Distal from each metatarsal are the phalanges, including the five proximal phalanges 84, the four middle phalanges 86, and the five distal phalanges 88. The first phalanx, i.e., the phalanx extending from the first metatarsal 74, has a proximal phalanx 84 and a distal phalanx 88, but no medial phalanx.

Figure 1:
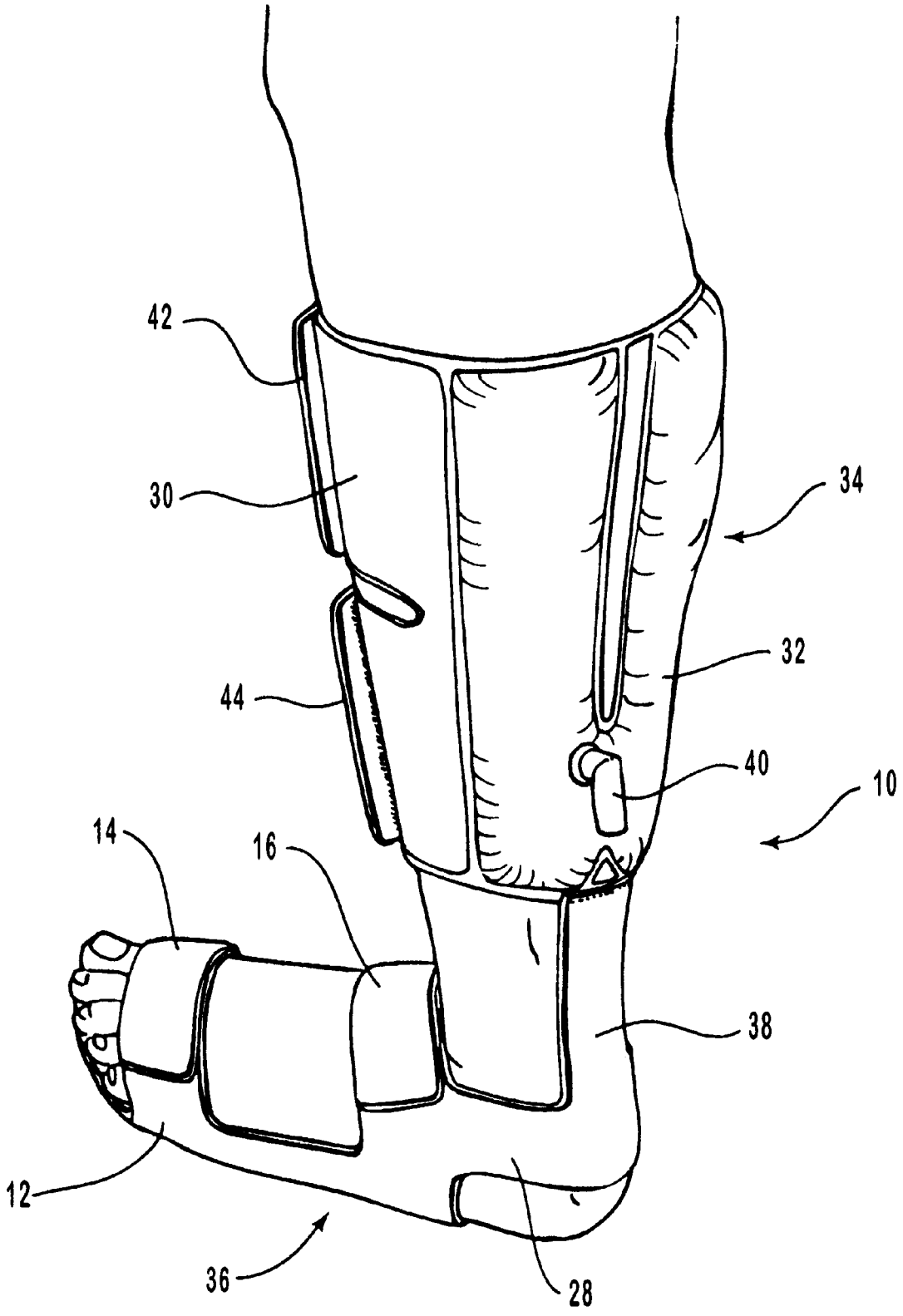
FIG. 1 is a diagram illustrating the calf compression portion and foot compression portion of one embodiment of the present invention.

Referring now to FIG. 1, a perspective view of one embodiment of the present invention is shown generally as 10. This embodiment includes a foot compression portion shown generally as 36 and a calf compression portion shown generally as 34. The details of these two portions are presented below, but the foot compression portion is designed to apply compressive forces to designated areas of the foot and/or ankle. The calf compression portion is designed to apply compressive forces to designated areas of the calf.

Embodiments within the scope of this invention may include compressing means for applying a compressive force to selected portions of a foot when the compressing means is held substantially against the portions of the foot and actuated, and retaining means for retaining the compressing means substantially against the foot. In FIG. 1, such retaining means is illustrated by retaining structure 12. Retaining structure 12 preferably uses a pile material such as that used in hook and pile fasteners like Velcro®. The pile material preferably covers the entire surface of the retaining structure so that the retaining structure can be held in place by double-backed hook closures as described hereafter.

Retaining structure 12 preferably encloses an inflatable bladder. The inflatable bladder is one example of compressing means for applying a compressive force to selected portions of the foot. By tailoring the locations and extent of the bladder within retaining structure 12, the bladder may be held against desired portions of the foot in order to apply a compressive force thereto. In the embodiment illustrated in FIG. 1, retaining structure 12 has one set of straps 14 that can be secured in front of the tarsal region and a second set of straps 16 that can be secured in the upper tarsal region of the foot.

Embodiments within the scope of this invention may also have a third strap 28 which extends posteriorly around the Achilles tendon. Straps 14, 16, and 28 help hold retaining structure 12 in a desired location so that the inflatable bladder enclosed with retaining structure 12 will apply compressive forces to the desired portions of the foot and ankle. If the inflatable bladder extends within any or all of these straps, compressive forces can also be exerted in the regions of the foot covered by the straps. Retaining structure 12 along with its enclosed bladder is sometimes referred to as foot compression portion 36. The details of foot compression portion 36 and the design of the bladder and location of the various compressive forces of foot compression portion 36 are described in greater detail below.

Embodiments within the scope of the present invention may also include compressing means for applying a compressive force to the dorsal side of the calf and retaining means for retaining this compressing means substantially against the dorsal side of the calf. In FIG. 1, such retaining means is illustrated by retaining structure 30. Retaining structure 30 is preferably constructed, like retaining structure 12, from a pile material like that used in hook and pile fasteners. Retaining structure 30 also preferably encloses the compressing means for applying a compressive force against the dorsal side of the calf. In FIG. 1, such compressing means may include, by way of example and not limitation, inflatable bladder 32. Inflatable bladder 32 is preferably completely enclosed by retaining structure 30 so that inflatable bladder 32 can be held substantially against the dorsal side of the calf. When a fluid is forced into inflatable bladder 32, inflatable bladder 32 expands and exerts a compressive force on the appropriate locations of the calf. Retaining structure 30, along with associated inflatable bladder 32 is sometimes referred to as calf compression portion 34.

Figure 2:
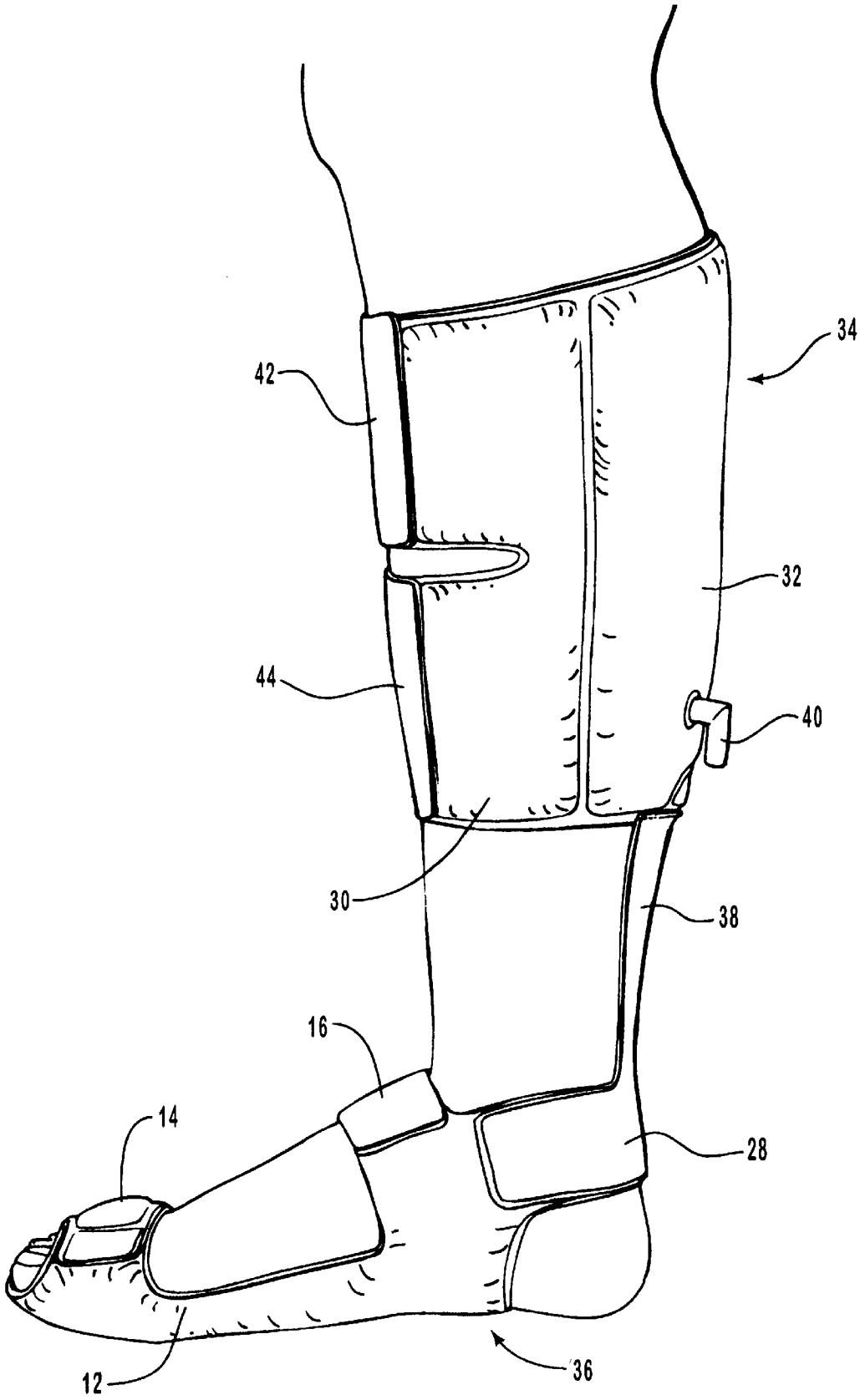
FIG. 2 is a side view of the calf compression portion and foot compression portion of one embodiment of the present invention.

Referring next to FIG. 2, the connection between calf compression portion 34 and foot compression portion 36 is discussed. In order to aid in the positioning of foot compression portion 36 and calf compression portion 34, calf compression portion 34 and foot compression portion 36 may be attached to form a single device. In FIG. 2, calf compression portion 34 and foot compression portion 36 are connected by attachment 38. Attachment 38 may be a strip of material, such as the pile material used for retaining structure 12 and retaining structure 30. Although not required, it is preferred that attachment 38 not contain compressing means such as an inflatable bladder. In this way, it is possible to separate calf compression portion 34 from foot compression portion 36 by cutting through attachment 38. Once the two portions are separated, the calf compression portion may be used independently from the foot compression portion. This may create an advantage over present treatment regimes for individuals suffering from extreme sensitivity in the foot region. For example, for individuals with extreme sensitivity of the foot due to reduced vascular blood flow, the calf compression portion may be applied to the patient and compression therapy initiated. Once the compression therapy has increased the vascular blood flow to the foot, sensitivity to compression of the foot may be reduced to the point that compression therapy of the foot is better tolerated. The foot compression portion, which was severed from the calf compression portion, may then be added to the patient in order to provide a combined foot/calf compression therapy.

When the compressing means for applying a compressive force to the dorsal side of the calf is an inflatable bladder, embodiments may include filling means for filling the bladder with a fluid from a fluid source. Such filling means may include a large bore fitting such as fitting 40 of FIG. 2. By making fitting 40 relatively large bore, the inflation and deflation times may be substantially decreased in order to reach the peak compressive force faster and remove the peak compressive force faster.

As illustrated in FIGS. 1 and 2, fitting 40 may be located in the lower portion of inflatable bladder 32. Locating fitting 40 in the lower portion of inflatable bladder 32 allows a progressive compressive force to be applied to the calf. As bladder 32 fills with a fluid, the compressive force generated by the bladder will be strongest at the bottom and then progress upward toward the top of the calf until the peak compressive force is reached all along the calf. Such a progressive force may help push the blood in the veins toward the As previously mentioned, retaining structure 12 and retaining structure 30 preferably are made from pile material, such as that used in hook and pile fasteners. Furthermore, it is preferable that all straps, such as straps 14, 16, and 28 of foot compression portion 36 and straps 42 and 44 of calf compression portion 34, also be manufactured from pile material. These straps may then be held in place by a double-sided hook fastener, manufactured from the same hook material as a hook and pile fastener. The double-sided hook fastener has hook material on both sides. This double-sided hook fastener is then placed between a strap and the retaining structure. The double-sided hook material then grabs the pile material of the strap and the pile material of the retaining structure and keeps the strap in place. Using a double-sided hook fastener in this manner reduces the cost of manufacture and provides greater flexibility in adjusting the straps to fit a wider range of patients.

Figure 3:
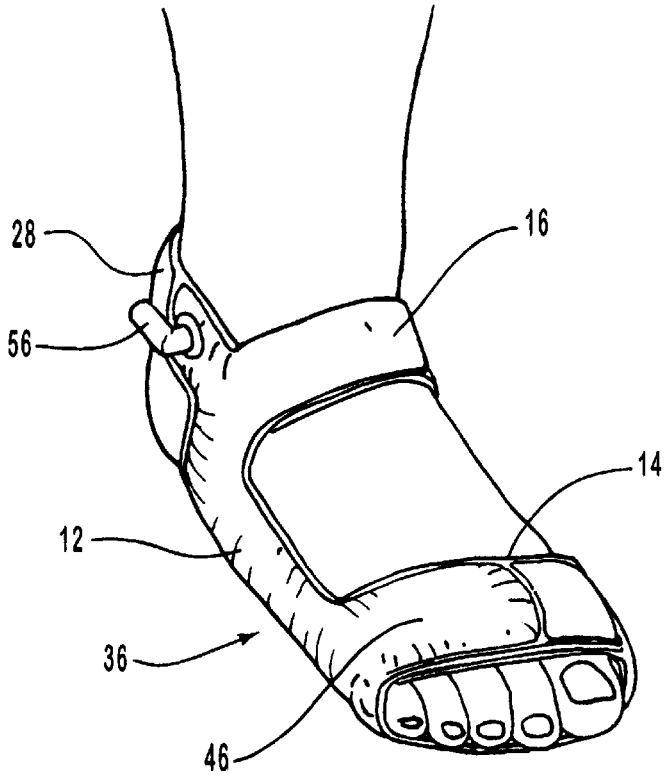
FIG. 3 is a view of the foot compression portion of one embodiment of the present invention.
Figure 4:
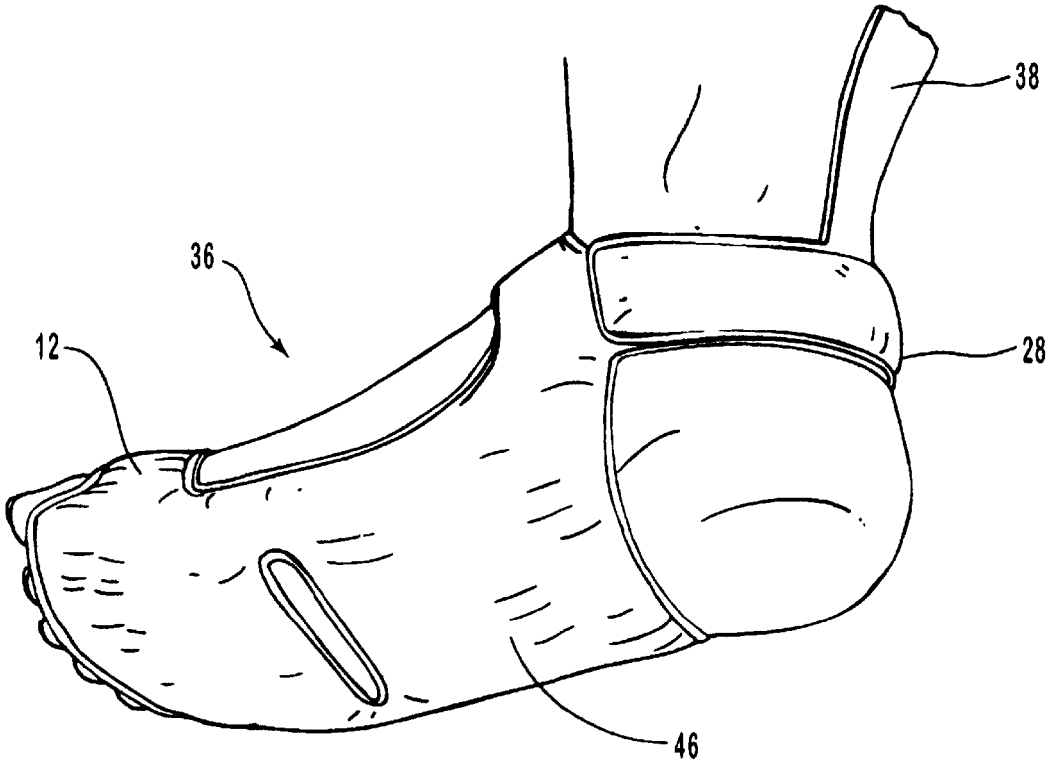
FIG. 4 is another view of a foot compression portion of one embodiment of the present invention.

Referring now to FIGS. 3 and 4, the details of foot compression portion 36 and the compressive forces applied by foot compression portion 36 are presented. As previously described, embodiments within the scope of this invention may include compressing means for applying a compressive force to selected portions of the foot. Also as previously described for foot compression portion 36, such compressing means may include, but are not limited to, an inflatable bladder such as inflatable bladder 46 of FIGS. 3 and 4. Inflatable bladder 46 may be adapted to apply various types of compressive forces. This section will explain the various types of compressive forces of the present invention and illustrate where they may be applied.

In one preferred embodiment of the present inventions, inflatable bladder 46 is not in fluid communication with inflatable bladder 32. By keeping the two bladders separate and distinct, calf compression portion 34 can be more easily severed from foot compression portion 36 and used separately.

Embodiments within the scope of this invention may be adapted to apply an upward compressive force to the sole of the foot from in front of the heel and extending past the ball of the foot under the phalanges. The structure of one embodiment designed to apply such a force is best illustrated in FIG. 4. As illustrated therein, inflatable bladder 46 extends from just in front of the heel to past the bottom of the foot and under the phalanges. A bladder in this portion of the foot will apply an upward compressive force to the sole of the foot. This upward compressive force mimics the compressive force given to the bottom of the foot when an individual walks. Prior art devices have applied compressive forces to a portion of the bottom of the foot. However, such prior art devices have been limited to compressive forces between the ball of the foot and the heel of the foot. In the present invention, the compressive force extends past the ball of the foot under the phalanges. This allows the compressive force to more closely mimic the compressive force exerted on a foot when an individual walks.

Embodiments within the scope of this invention may also be adapted to exert a downward compressive force in front of the tarsal region of the foot. As previously described, the phrase "in front of the tarsal region of the foot" includes that region of the foot distal of the cuneiforms (medial cuneiform 68, middle cuneiform 70, and lateral cuneiform 72 of FIGS. 5*a* and 5*b*). Such a compressive force may be generated, for example, by extending inflatable bladder 46 across the region covered by strap 14. This is perhaps best illustrated in FIG. 3. As previously described, the inflatable bladder may be enclosed within retaining structure 12. A portion of inflatable bladder 46 may thus extend inside strap 14 in order to exert a downward compressive force in front of the tarsal region of the foot.

Embodiments within the scope of this invention may also be adapted to apply a downward compressive force in the upper tarsal region of the foot. The "upper tarsal region" of the foot as used herein includes the region proximal of the cuneiforms (68, 70 and 72 of FIGS. 5*a* and 5*b*). Thus, a strap extending across the upper cuboid 67 and the navicular 66 may exert a downward compressive force in the upper tarsal region if an inflatable bladder is enclosed therein. Inflatable bladder 46 may therefore extend underneath strap 16 of FIG. 3 in order to exert a downward compressive force as just described.

Figure 7:
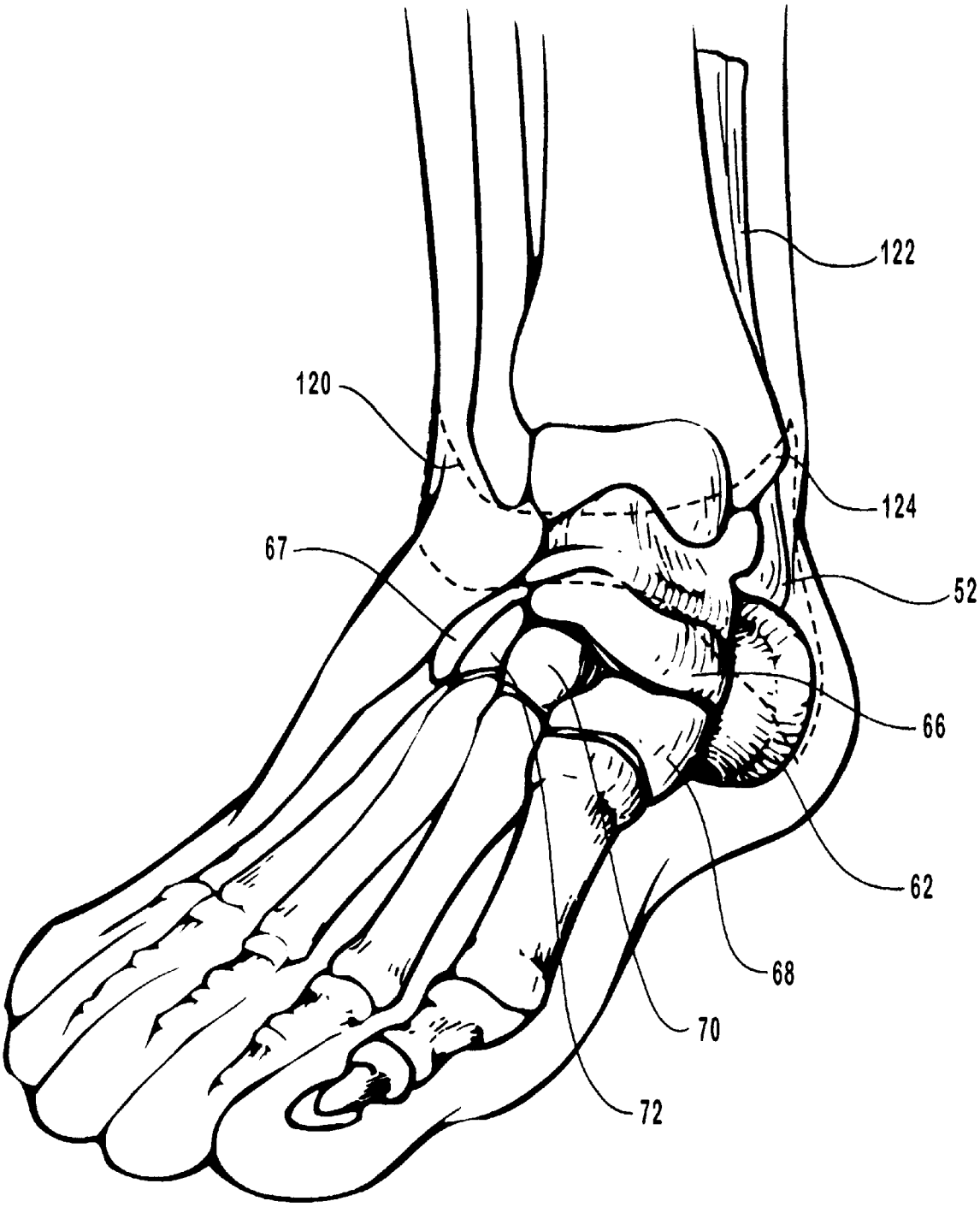
FIG. 7 is a view of the foot showing a particular compression region.

Embodiments within the scope of this invention may also be adapted to exert a compressive force on at least one of either side of the ankle anywhere in a region bounded essentially by the posterior portion of the calcaneus 62, the medial malleolus of the tibia, the Achilles tendon, and the posterior portion of the navicular 66. This region may be identified by referring to FIG. 7. In FIG. 7, the region enclosed by dashed line 120 is bounded essentially by the posterior portion of the calcaneus 62, the achilles tendon 122, the medial malleolus 124, and the posterior portion of the navicular 66. In FIGS. 3 and 4, strap 28 extends around the back of the ankle and covers at least a portion of this region. A compressive force may be applied to at least a portion of this region by extending bladder 46 under strap 28. Extending bladder 46 in this manner will cause a compressive force to be exerted on both sides of the ankle. A compressive force may be exerted on only one side by appropriately tailoring the extent of inflatable bladder 46 or by designing a different bladder configuration and retaining structure.

Although the above discussion has been described with respect to a single inflatable bladder covering all regions where compressive forces are desired, it would also be possible to utilize separate bladders in order to allow separate compressive forces to be exerted only where desired.

For example, embodiments within the scope of this invention may include bladders that exert either all of the compressive forces previously described, or various combinations of the compressive forces, or a single compressive force.

Embodiments of the present invention may be adapted to be incapable of applying a downward compressive force to the midtarsal region. As previously described, applying a downward compressive force to the midtarsal region may adversely affect certain sensitive patient groups. For example, in the case of patients with diabetes, a downward compressive force in this region may lead to tissue damage. The embodiments illustrated in FIGS. 1 through 4 illustrate an open region above the midtarsal region of the foot. Leaving this region open prohibits the present invention from generating a downward compressive force in the midtarsal region. Furthermore, several benefits are achieved that are not available in the prior art. For example, several observations can be made of the skin and underlying structures in the area exposed by the window. First, the health of the skin tissue can be assessed by looking at skin color and texture. Second, skin blood flow can be assessed by applying sensors such as a laser Doppler flux probe or a photo plethysmograph probe. Third, an underlying artery can be palpated for pulsality by hand or by using an electronic monitor incorporating a strain sensitive element or continuous wave ultrasonic Doppler probe that is placed on the skin over the artery. All of these features can help a physician assess the effectiveness of a treatment regime using the present invention to increase vascular blood flow. The physician can then tailor the treatment regime to achieve the greatest benefit while minimizing any undesirable effects.

In a preferred embodiment, the invention is adapted to leave at least a portion of the dorsalis pedis artery in the midtarsal region open for visual and/or instrumental monitoring. Referring now to FIG. 6, a diagram of a foot 60 is shown, wherein the same reference numerals as in other figures are used to denote the same elements. The tibia 90 and fibula 92 are also shown for clarity. The arterial structure of foot 60 includes the following arteries as labeled in FIG. 6: the anterior tibial artery 94, the perforating branch of peroneal artery 96, the anterior lateral malleolar artery 100, the dorsalis pedis artery 102, the medial tarsal arteries 104, the lateral tarsal artery 106, the arcuate artery 108, the dorsal metatarsal arteries 110, the posterior perforating branches from the deep plantar arch 112, the deep plantar artery 114, the anterior perforating branches from the plantar metatarsal arteries 116, and the dorsal digital arteries 118.

Thus, preferably at least a portion of the region of the dorsalis pedis artery 102 from a proximal monitoring point A, where the deep plantar artery 114 branches from the dorsalis pedis artery, to a distal monitoring point B, where the dorsalis pedis artery 102 branches between the proximal phalanges 84, remains open for visual and/or instrumental monitoring. A portion of this monitoring region can remain open for visual and/or instrumental monitoring, or substantially all of the monitoring region can remain open, depending upon the type of monitoring desired. Thus, it may be desired that at least half of the monitoring region remain open, at least three-fourths of the monitoring region remain open, at least 90% of the monitoring region remain open, or substantially all of the monitoring region remain open. The monitoring region of the dorsalis pedis artery from points A to B is particularly advantageous for several reasons. The top surface of the foot in the monitoring region is relatively flat, making the region well suited for attaching probes. In addition, the curvature in the dorsalis pedis artery at point B, where a branch extends downward between the toes, allows monitoring devices such as a Doppler probe to be positioned in a region of very strong potential signal, since the probe can be aligned to monitor parallel to blood flow, rather than at a more oblique angle.

If the compressing means for applying a compressive force to selected portions of the foot comprises an inflatable bladder, such as inflatable bladder 46, then embodiments within the scope of the invention may include filling means for filling the bladder with a fluid from a fluid source. In the embodiment illustrated in FIG. 3, such filling means can include, for example, fitting 56. Fitting 56 may be a large bore fitting in order to allow rapid inflation and deflation of the foot compression portion.

The inflation, deflation, and delay rate as well as the pressure for foot inflation portion 36 and calf inflation portion 34 are adjustable. When inflating both the foot and calf portion, an inflation delay time between the start of inflation for each portion can be used and adjusted from zero seconds (for simultaneous inflation) to about two or more seconds (for progressive inflation). In one embodiment, the bladders are rapidly inflated and held at the preselected inflation pressure for between about two seconds to about eighteen seconds. The inflation pressure can range between about 50 mmHg to about 150 mmHg. The bladders may then be rapidly deflated in order to reach a pressure of between about 0 mmHg to about 10 mmHg and held at that pressure for between about 6 seconds to about 60 seconds. When progressive inflation is used, the foot portion may be inflated first with the calf portion being inflated at some time later. When used together, the inflation time, deflation time, and pressure for both the foot portion and the calf portion may be the same, or they may be different to tailor the treatment regime to the individual patient. Since the inflatable bladders of the foot portion and the calf portion are separate, when the foot portion and calf portion are used together, separate inflation tubes are preferably provided to the foot portion and the calf portion. This allows either simultaneous or progressive inflation.

The present invention accommodates treatment of deep vein thrombosis through rapid compression of areas of the foot, ankle, and calf. The invention inflation rate, inflation delay time, peak pressure, and cycle time can be adjusted to provide a rapid compression that creates high blood velocities and moves large blood volumes. This may provide the patient with a more effective prophylaxis against deep vein thrombosis.

It should be appreciated that the present invention is hot limited to the various devices described above, but also includes methods of using such devices to improve blood flow, by operating the devices as described, as well as methods in which the skin health and/or arterial blood flow are monitored visually and/or instrumentally; these methods are described above in connection with the apparatus used to carry out the methods.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed as desired to be secured by United States Letters Patent is:

1. A device for improving vascular blood flow in the lower extremities of a patient, the device comprising:

(a) compressing means for applying a compressive force to selected portions of a foot of the patient, the compressing means being adapted to apply:
  (i) an upward compressive force to the sole of the foot from in front of the heel and extending under a substantial portion of the phalanges; and
  (ii) a downward compressive force to the dorsal side of at least a portion of the phalanges; and
(b) retaining means for retaining the device against the foot;

wherein the compressing means and retaining means are configured so that at least half of the region of the dorsalis pedis artery from a proximal monitoring point where the deep plantar artery branches from the dorsalis pedis artery, to a distal monitoring point where the dorsalis pedis artery branches between the proximal phalanges remains open for visual and/or instrumental monitoring.

2. The device of claim 1, wherein substantially the entire region from the proximal monitoring point to the distal monitoring point remains open for visual and/or instrumental monitoring.

3. The device of claim 1, wherein the compressing means is further adapted to apply a compressive force around the Achilles tendon in at least a portion of a region extending from the calcaneus to the medial or lateral malleolus.

4. The device of claim 1, wherein the compressing means is further adapted to apply a downward compressive force to the upper tarsal region of the foot.

5. The device of claim 1, wherein the compressing means is further adapted to apply a compressive force to the dorsal side of a calf of the patient.

6. The device of claim 1, wherein the compressing means comprises a bladder that expands to exert a compressive force when a fluid is placed therein.

7. A device for improving vascular blood flow in the lower extremities of a patient, the device comprising:
(a) compressing means for applying a compressive force to selected portions of a foot and ankle of the patient, the compressing means being adapted to apply:
  (i) an upward compressive force to the sole of the foot from in front of the heel and extending under a substantial portion of the phalanges;
  (ii) a downward compressive force to the dorsal side of at least a portion of the phalanges; and
  (iii) a compressive force around the Achilles tendon in at least a portion of a region extending from the calcaneus to the medial or lateral malleolus; and
(b) retaining means for retaining the device against the foot;

wherein the compressing means and retaining means are configured so that at least half of the region of the dorsalis pedis artery from a proximal monitoring point where the deep plantar artery branches from the dorsalis pedis artery, to a distal monitoring point where the dorsalis pedis artery branches between the proximal phalanges remains open for visual and/or instrumental monitoring.

8. The device of claim 7, wherein substantially the entire region from the proximal monitoring point to the distal monitoring point remains open for visual and/or instrumental monitoring.

9. The device of claim 7, wherein the compressing means is further adapted to apply a downward compressive force to the upper tarsal region of the foot.

10. The device of claim 7, wherein the compressing means is further adapted to apply a compressive force to the dorsal side of a calf of the patient.

11. The device of claim 7, wherein the compressing means comprises a bladder that expands to exert a compressive force when a fluid is placed therein.

12. A device for improving vascular blood flow in the lower extremities of a patient, the device comprising:
(a) first compressing means for applying a compressive force to selected portions of a foot of the patient, the first compressing means being adapted to apply:
  (i) an upward compressive force to the sole of the foot from in front of the heel and extending under a substantial portion of the phalanges; and
  (ii) a downward compressive force to the dorsal side of at least a portion of the phalanges;
(b) first retaining means for retaining the first compressing means against the foot, wherein the first compressing means and first retaining means are configured so that at least half of the region of the dorsalis pedis artery from a proximal monitoring point where the deep plantar artery branches from the dorsalis pedis artery, to a distal monitoring point where the dorsalis pedis artery branches between the proximal phalanges remains open for visual and/or instrumental monitoring;
(c) second compressing means for applying a compressive force to at least a portion of the dorsal side of the calf of the patient; and
(d) second retaining means for retaining the second compressing means against the calf.

13. The device of claim 12, wherein substantially the entire region from the proximal monitoring point to the distal monitoring point remains open for visual and/or instrumental monitoring.

14. The device of claim 12, wherein the first compressing means is further adapted to apply a downward compressive force to the upper tarsal region of the foot.

15. The device of claim 12, wherein the first compressing means is further adapted to apply a compressive force around the Achilles tendon in at least a portion of a region extending from the calcaneus to the medial or lateral malleolus.

16. The device of claim 12, wherein the first compressing means comprises a first bladder that expands to exert a compressive force when a fluid is placed therein, and the second compressing means comprises a second bladder that expands to exert a compressive force when a fluid is placed therein.

17. A device for improving vascular blood flow in the lower extremities of a patient, the device comprising:
(a) first compressing means for applying a compressive force to selected portions of a foot of the patient, the first compressing means being adapted to apply:
  (i) an upward compressive force to the sole of the foot from in front of the heel and extending under a substantial portion of the phalanges;
  (ii) a downward compressive force to the dorsal side of at least a portion of the phalanges; and
  (iii) a compressive force around the Achilles tendon in at least a portion of a region extending from the calcaneus to the medial or lateral malleolus;
(b) first retaining means for retaining the first compressing means against the foot, wherein the first compressing means and first retaining means are configured so that at least half of the region of the dorsalis pedis artery from a proximal monitoring point where the deep plantar artery branches from the dorsalis pedis artery, to a distal monitoring point where the dorsalis pedis artery branches between the proximal phalanges remains open for visual and/or instrumental monitoring;
(c) second compressing means for applying a compressive force to at least a portion of the dorsal side of the calf of the patient; and (d) second retaining means for retaining the second compressing means against the calf.

18. The device of claim 17, wherein substantially the entire region from the proximal monitoring point to the distal monitoring point remains open for visual and/or instrumental monitoring.

19. The device of claim 17, wherein the first compressing means is further adapted to apply an upward compressive force to the sole of the foot from in front of the heel and extending under a substantial portion of the phalanges.

20. The device of claim 17, wherein the first compressing means is further adapted to apply a downward compressive force to the dorsal side of at least a portion of the phalanges.

21. The device of claim 17, wherein the first compressing means is further adapted to apply a downward compressive force in the upper tarsal region of the foot.

22. The device of claim 17, wherein the first and second retaining means can be separated so that the second compressing means can be applied apart from the first compressing means.

23. A device for improving vascular blood flow in the lower extremities of a patient, the device comprising:

(a) a foot compression portion comprising a bladder adapted to receive a fluid to apply compressive forces to selected portions of a foot and an ankle of the patient, and a retaining structure enclosing the bladder and retaining the bladder against the foot and ankle, the compressive forces including:

(i) an upward compressive force to the sole of the foot from in front of the heel and extending under a substantial portion of the phalanges;

(ii) a downward compressive force to the dorsal side of at least a portion of the phalanges;

(iii) a downward compressive force in the upper tarsal region; and (iv) a compressive force around the Achilles tendon in at least a portion of a region extending from the calcaneus to the medial or lateral malleolus;

wherein the foot compression portion is configured so that at least half of the region of the dorsalis pedis artery from a proximal monitoring point where the deep plantar artery branches from the dorsalis pedis artery, to a distal monitoring point where the dorsalis pedis artery branches between the proximal phalanges remains open for visual and/or instrumental monitoring; and (b) a calf compression portion comprising a bladder adapted to receive a fluid to apply a compressive force to the dorsal side of the calf and a retaining structure enclosing the bladder and retaining the bladder against the calf.

24. The device of claim 23, wherein substantially the entire region from the proximal monitoring point to the distal monitoring point remains open for visual and/or instrumental monitoring.

25. The device of claim 23, wherein the foot compression portion is attached to the calf compression portion so that the foot compression portion and the calf compression portion can be applied to the patient together.

26. The device of claim 25, wherein the foot compression portion can be detached from the calf compression portion so that the calf compression portion can be applied separately to the patient.

27. The device of claim 23, wherein the calf compression portion is adapted so that the compressive force applied to the dorsal side of the calf is strongest in a region of the calf distal from the heart and progressively weaker in regions of the calf more proximal to the heart so that blood is pushed upward toward the heart of the patient.

* * * * *

UNITED STATES PATENT AND TRADEMARK OFFICE

CERTIFICATE OF CORRECTION

PATENT NO. : 6,358,219 B1
DATED : March 19, 2002
INVENTOR(S) : Ed Arkans

It is certified that error appears in the above-identified patent and that said Letters Patent is hereby corrected as shown below:

Title page,
U.S. PATENT DOCUMENTS, change "Chrisoffel" to -- Christoffel --

Column 3,
Line 4, after "during" change "waking." to -- walking --
Line 27, after "foot" delete the comma Column 7,
Line 28, after "toward the" insert -- heart. --

Column 10,
Line 48, after "invention is" change "hot" to -- not --

Signed and Sealed this

Third Day of December, 2002

JAMES E. ROGAN
*Director of the United States Patent and Trademark Office*